United States Patent [19]

Frigo

[11] 4,042,120

[45] Aug. 16, 1977

[54] MACHINE FOR STRIPPING FROM FRAMES, PARTICULARLY PIN FRAMES, MATERIALS RESTRAINED TO SAID FRAMES

[75] Inventor: Vito Frigo, Cervignano del Friuli (Udine), Italy

[73] Assignee: Ausatuft S.p.A., Italy

[21] Appl. No.: 606,529

[22] Filed: Aug. 21, 1975

[30] Foreign Application Priority Data

Sept. 17, 1974 Italy ..... 27360/74

[51] Int. Cl.[2] ..... B65G 47/91

[52] U.S. Cl. ..... 214/1 BB; 214/8.5 C

[58] Field of Search ..... 112/121.12, 121.29; 214/1 BB, 89, 95, 86 R, 146.5, 130 R, 1 S, 8.5 C

[56] References Cited

U.S. PATENT DOCUMENTS

| | | | |
|---|---|---|---|
| 3,178,040 | 4/1965 | Nelson | 214/1 BB |
| 3,382,825 | 5/1968 | Cash | 112/121.29 |
| 3,408,689 | 11/1968 | Heiner | 214/1 BB |
| 3,887,082 | 6/1975 | Posselt | 214/1 BB |

*Primary Examiner*—George E. A. Halvosa
*Assistant Examiner*—Gregory W. O'Connor
*Attorney, Agent, or Firm*—Steinberg & Blake

[57] ABSTRACT

A machine is disclosed for stripping textile materials, fabrics and the like from frames having a plurality of pins arranged about the periphery thereof. Such a machine comprises guides for accommodating dressed frames and positioning the same above an extractor plate upward movable to strip said material from the pin frame, an apparatus being provided for collecting the stripped material and evacuating the stripped frames.

7 Claims, 2 Drawing Figures

MACHINE FOR STRIPPING FROM FRAMES, PARTICULARLY PIN FRAMES, MATERIALS RESTRAINED TO SAID FRAMES

Frames are known for enabling the handling of substantially bidimensional products, such as textile materials, fabrics and the like. Such frames substantially consist of a strong framework carrying pins on one of its faces, the pins being nearly perpendicular to said face, on which the material to be processed is fastened in taut condition. Said frames enable the handling of said products, generally textile products having a poor dimensional stability of their own, which are to be subjected to various processes or treatments. For example, one of such processes or treatments may be that of impregnating said textile products with plastic materials, such polyethylene, or any suitable material, and molding thereof in suitable molds, so as to impart thereto a suitable spatial time-resistant shape. In any case, after the material carried by the frame has been processed, said frame can be cleared of the supported textile material, so as to be ready for receiving a textile material to be subjected to the process or treatment, while the processed textile material shall be supplied to further processing, or to use thereof.

Of course, the stripping operation of said frames could be manually carried out but, particularly where such frames are used in automated or semi-automated systems, this would involve a considerable labour and hence high costs.

The present invention proposes an automatic machine for removing from the frames said textile products following forming thereof, so that the latter can be separated, while permitting both the use of the textile product and reuse of the frames.

In order to attain these objects, a machine is provided for separating from frames, particularly frames having a plurality of pins arranged along the periphery thereof, materials which have been restrained to said frames, which machine is characterized by comprising guides for accomodating the dressed frames and holding the same, whereas stripping means act upon the material so as to strip it from the pins and bring it to a location at a moving carriage fitted with gripping means or jaws for gripping the material, said carriage subsequently moving to a discharge station where the material is discharged; said carriage and stripping means moving back to the initial position; further means being provided for ejecting the stripped frame.

Figure 1:
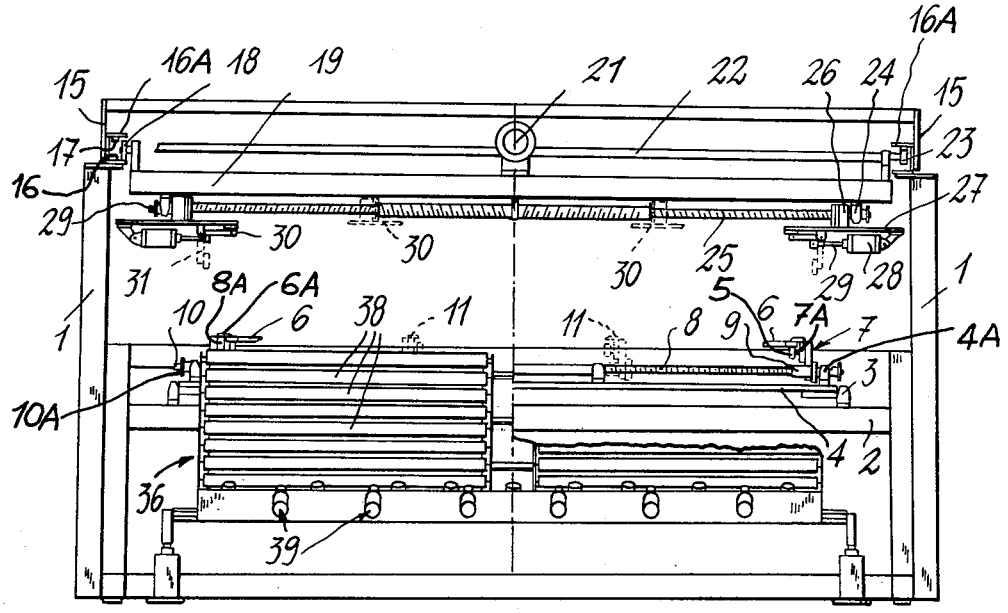
Figure 2:
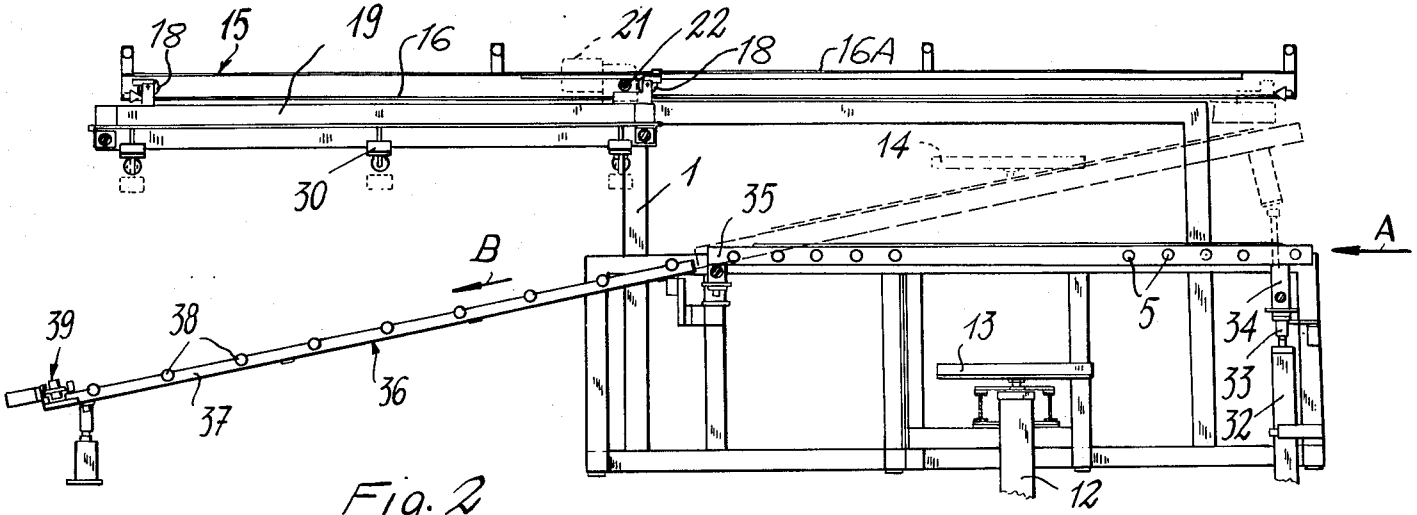

These and further features will become apparent from the following detailed description, given by mere way of unrestrictive example, reference being had to the accompanying drawings, in which:

FIG. 1 is a side view of the machine, taken on that side where the frames and material are ejected, with a portion of the ejecting roller plane cut away in order to show the members located behind the same; and FIG. 2 is a diagrammatic axial sectional view of the machine shown in FIG. 1, with parts being omitted for clarity.

In the following, when discussing the material dressing the frame, reference will be had to a carpet, in a merely exemplary assumption that the machine according to the present invention will be supplied with preformed carpets for motorcars, even though, as apparent, the invention is not to be intended as restricted to such a use.

Referring to the figures of the accompanying drawings, a machine according to the invention consists of a strong framework 1 carrying cross members 2 with a frame member bearing thereon, this frame member having longitudinal members 3 supporting further spaced apart coplanar cross members 4 parallel to one another, two of which carry stringers or plates 4A, in which shafts 8 are rotably mounted each having two side sections or lengths screw threaded in opposite directions. Each shaft 8 can be rotated by means of a handwheel applicable at 10 to one end of one of said shafts. On each of the shafts an internally threaded bushing 9 is mounted at the screw threaded sections or lengths thereof. The bushings located on a same side carry a longitudinal member 7. Axes or spindles 7A cantilever project from this longitudinal member and carry at the ends thereof rollers 5 acting as a support for the pin frame designated as a whole at 6. This frame 6 is clamped against rollers 5 by means of jaws or shoes 6A which can be raised and lowered by small pneumatic or hydraulic cylinders 8A secured to each longitudinal member 7.

On rotation of shafts 8, longitudinal members 7 can be moved to and away from one another in order to accomodate the width of pin frames 6 being subsequently used. The two shafts 8 are driven by a single handlewheel (at 10), by being interconnected, for example through a chain connection extending between two gear wheels 10A, each of which arranged at one end of said shafts. The closest positions for longitudinal members 7 are shown at 11 by broken lines.

Frame member 3 is hinged at 35 to framework 1, while a hydraulic or pneumatic cylinder is articulated to the other end and serves to incline said frame member 3 and assembly carried thereby. When jaws or shoes 6A are raised, a dressed frame can arrive from the direction shown by arrow A (FIG. 2) and enter the machine, for example by being driven by a conveyor belt: the frame will move on rollers 5 and continue its movement until contacting unillustrated stop members, which are arranged on the longitudinal members 7, so as to interfere with the frame to be moved to and secured at the desired position in connection with the frame length. Said stop members include a rotable arm which is moved to operative and inoperative positions by a hydraulic or pneumatic cylinder. Said arm is provided, for example, with a microswitch for closing said jaws or shoes 6A when a frame is in contact with the stop member.

Thus, the frames are blocked and a carpet secured thereon is on the top side of the frames, above an extractor means or device. This extractor device consists of a hydraulic or pneumatic cylinder 12, having a plate 13 attached to the movable piston thereof, on which plate is preferably mounted a template corresponding to the shape of the carpet to be removed from the frames, said template not being shown in the drawings for the sake of simplicity.

On frame blocking by means of a contactor, cylinder 12 is operated, so that plate 13 and carpet template will be raised to contact the carpet which is positioned thereupon, while said plate and template will upward move internally of the frame which is held at blocked position. As said piston continues its upward stroke, the carpet will be stripped from the pins (which are also upward facing), since the frame is maintained stationary by jaws or shoes 6A. Because of the template being arranged on plate 13, there will not be any undue strains on the carpet, which therefore can undergo deformations.

Once the carpet has been stripped from the frame, the piston will continue its upward stroke, until plate 13 has the position 14, shown by broken lines in FIG. 2. The carpet, not shown in the drawings, will be located there above.

Above said position 14, at the top of the machine frame 1, longitudinal guides 15 are secured, these guides extending throughout the machine length and somewhat projecting beyond the same.

In FIG. 2, said guides 15 outwardly project on that side from which the empty or stripped frames will be successively ejected, but of course such guides could extend on the most desired side of the machine. These guides carry tracks 16 and a rack 17 on a flange 16A thereof. By means of wheels 18, a carriage 19 is rollable on said tracks 16, which carriage is driven by an electric motor 21, mounted on carriage 19 and driving a shaft 22, which is carried by said carriage and terminates with gear wheels 23 meshing with racks 17. Thus, the carriage can take two positions, namely one position where it is above cylinder 12, and another position, shown in FIG. 2, where it is at the end of guides 15. Said one position corresponds to the loading position, whereas said other position corresponds to the unloading position.

Bearings 24 are fast with said carriage 19 and support two parallel double screw thread shafts 25, such a screw thread being engaged by bushings 26 fast with bases or platforms 27 carrying hydraulic or pneumatic cylinders 28. The two shafts 25 are connected by a chain drive, not shown. Owing to this arrangement, by rotating through the end of control 29 for one of said shafts 25, the bases or platforms 27 and cylinders 28 therewith can be transversely moved to or away from one another, to take the desired position depending on the size of the carpet which is to be removed.

To this end, pistons 29 of the cylinders 28 act on rotable jaws or shoes 30, capable of taking an open position 31, shown in FIG. 1 by dashed lines.

Now, it will be appreciated that, when carriage 19 is positioned above a formed carpet, which is at its highest position supported by the movable base or platform 13 at position 14 (the jaws or shoes 30 being at open position 31), should pistons 29 be biased to close said jaws or shoes, the carpet edge will be gripped by said jaws or shoes, thus clamping the carpet edge between said jaws or shoes 30 and plates 27.

Such jaws or shoes are advantageously arranged on all the four sides of the carpet, so that said carpet can be firmly gripped. The control to jaws or shoes 30, and hence pistons 29, can be suitably given, for example, from said platform or base 13 by a limit switch when it is at top dead center postion.

Thus, the carpet is gripped by said jaws or shoes 30, and a further limit switch, in this case operated by said jaws or shoes, provides for driving the extraction base or platform 13 from upper position 14 to its lower position, thereby releasing the carpet which remains hanging or suspended, as held only by jaws or shoes 30. A further limit switch which, for example, may be operated by the extraction base or platform 13, when it reaches its lowest position 13, provides for starting said motor 21, and therefore the whole carriage 19 will be moved outwardly of the machine to the position shown in FIG. 2. Upon reaching the end position, said carriage will meet another limit switch, also not shown for the sake of simplicity, which provides for opening said jaws or shoes 30, as shown in FIG. 2 by dashed lines, and therefore the carpet will be unloaded into a suitable container located there below, or will fall down onto a conveyor belt running below. Said limit switch can then drive motor 21 in inverse direction, and therefore carriage 19 can move back to the initial or loading position, where it will be stopped by another limit switch ready for a new carpet. At the same time, a suitable control, such as a microswitch controlled by carriage 19, will have operated the hydraulic or pneumatic cylinder 32, the rod of which is articulated at 33 to a lug or projection 34 fast with the assembly comprising said frame 3 and parts associated therewith. Therefore, under the action of the piston, the frame will rotate about axis 35, taking the position shown in FIG. 2 by dashed lines. Upon reaching such a position, a suitable limit switch will provide for opening jaws 6A, so as to clear frame 3, and in the case to rotate, such as by means of hydraulic or pneumatic cylinders, further obstacles to the movement of the frames. Thus, frame 3 is free to move by gravity on rollers 5 and can be ejected from the machine in the direction shown by arrow B, then moving on a suitable outlet table, generally indicated at 36, and comprising a framework 37, on which rollers 38 are freely rotatable. At the end of their stroke or travel, the frames will meet a shock absorber, generally indicated at 39, which dampens the impact thereof and at the same time operates a limit switch inverting the flow in cylinder 32, which therefore retracts its piston which resumes its initial position, and the machine is ready to receive a new frame coming from A to repeat the above described cycle, while manually or by suitable means providing for evacuating the stripped and unloaded frame.

What I claim is:

1. A machine for separating from frames, particularly pin frames, materials which have been restrained to said frames, such a machine comprising extractor means and guide means for accommodating dressed frames and positioning the same above said extractor means, the latter being upward movable to strip said material from said pin frame resulting in stripped material and stripped frames, means being provided for receiving said stripped material and evacuating said stripped frames.

2. A machine as claimed in Claim 1, wherein said means for receiving said stripped materials comprise a carriage carrying gripping means for releasably gripping the edges of the stripped material, said carriage being provided with means for moving the carriage to a cantilever position projecting from the machine and with means for actuating said gripping means for releasing the stripped material.

3. A machine as claimed in Claim 2 wherein said means for moving said carriage include guides on which said carriage can move, whereas for releasing the stripped material said gripping means are opened when the carriage is in said cantilever position projecting from the machine.

4. A machine as claimed in Claim 2, wherein to strip the material from its associated frame provision is made for said extractor means, the latter including a hydraulic means carrying a base or platform capable of taking two positions, of which one is a bottom dead center position where it does not interfere with a textile product, and of which the other is a top dead center position, the stripping operation being carried out during an upward piston stroke of a piston of said hydraulic means.

5. A machine as claimed in claim 4, wherein the top dead center position of said base or platform corresponds to the position at which the edges of the stripped material are about at the same level as the gripping means.

6. A machine as claimed in Claim 1, wherein said guide means for accommodating the dressed frames are hinged transversely of the machine and fluid-pressure means connected with said guide means for causing said guide means to take an inclined position and an outlet table for stripped frames aligned with said guide means when the latter is in said inclined position thereof.

7. A machine as claimed in claim 1, wherein said guide means are movable and provided with means for clamping the frames.

* * * * *